United States Patent [19]

Corsette et al.

[11] 4,170,047

[45] Oct. 9, 1979

[54] VANED ANTI-VORTEX POOL DRAIN COVER

[76] Inventors: Douglas F. Corsette, 6559 Firebrand St., Los Angeles, Calif. 90045; Frank J. Jedlick, 8251 Seville Ave., Apt. B, Southgate, Calif. 90280

[21] Appl. No.: 920,672

[22] Filed: Jun. 30, 1978

[51] Int. Cl.[2] ..... A47K 1/14

[52] U.S. Cl. ..... 4/293; 4/172; 4/172.17; 4/286; 4/292

[58] Field of Search ..... 4/172, 172.19, 172.15, 4/172.17, 292, 293, 290, 286, 288; 210/163, 164–165, 169; 128/66, 369

[56] References Cited

U.S. PATENT DOCUMENTS

| | | | |
|---|---|---|---|
| 2,316,724 | 4/1943 | Sperry | 4/288 |
| 3,343,774 | 9/1967 | Pryor | 4/293 |
| 3,392,844 | 7/1968 | Decarie | 4/292 |
| 4,115,878 | 9/1978 | Johnson et al. | 4/172.17 |

*Primary Examiner*—Henry K. Artis
*Attorney, Agent, or Firm*—Henry M. Bissell

[57] ABSTRACT

A protective cover for swimming pools drains and the like. The cover is of a unitary construction and is preferably injection-molded from a flexible, tough, spring-like plastic. The cover includes an outer, annular rim designed to rest on a sub-main drain or the like. The main cover has no holes and features a generally sine wave or bellows spring design. The central portion is inwardly or downwardly curved, and forms a portion of a sphere having its center on a line normal to a plane passing through the main cover. The central portion is surrounded by another inwardly curved portion which preferably is provided on its underside with a circular projection extending normal to the plane of the cover to lend it mechanical rigidity. The outer main cover portion is upwardly curved and is connected to the ring portion through a plurality of stanchions in the form of vanes extending in radial directions. Due to its spring-like construction, the cover will spring back under loads within elastic limits of the material and even limited overloads causing a permanent set will not cause the cover to lose its full function.

27 Claims, 6 Drawing Figures

VANED ANTI-VORTEX POOL DRAIN COVER

BACKGROUND OF THE INVENTION

1. Field of the Invention

This invention relates generally to equipment for pools and particularly relates to a drain cover for swimming pools and the like.

2. Description of the Prior Art

Swimming pools require a suitable outlet for drawing water from the pool for recirculation and purification. This outlet (the "main drain") is customarily recessed at the low point in the pool and requires a perforated cover or grate to keep larger objects from clogging the outlet. Swimmers must also be kept away from the outlet since the pump suction may hold them underwater until they drown. For this purpose many drain grates and the like have been developed in the past. However, most of the drain grates consist of a substantially flat cover for the main drain. This cover plate is perforated or provided with annular drainage rings. Thus the rings of the cover may be interconnected by radially extending spokes.

Such a construction presents various hazards to the user of the pool. In the first place, there is considerable suction at the cover, even though it is displaced from the outlet pipe opening proper. Hence, it is possible for a swimmer who might rest momentarily with his back or chest on such a drain cover to be prevented from getting up again by the strong suction of the water, and may still result in drowning. In some drain covers, the openings may be large enough for a child's finger to get caught, again possibly resulting in drowning. Other drain covers, while avoiding the grate pattern, incorporate a lip or ledge extending upward from the bottom of the pool, thus causing a swimmer to stub his toes.

Still another problem with prior art drain covers is that they are subject to failure from certain applied loads, such as a swimmer pushing up from the bottom of the swimming pool or jumping into the pool feet first from the edge or from a diving board, especially in the case of shallow pools for small children. Such loads may cause damage and may fracture the cover which may again, result in accidents.

Some of the prior art drain grates have been made of metal. In that case, the Uniform Swimming Pool Code, promulgated by the International Association of Plumbing and Mechanical Officials, requires that such a metal cover be electrically grounded to prevent possibility of electrical shock to a swimmer. Thus a plastic drain cover solves the problem without the need for grounding.

Other prior art drain covers have featured a directional-flow inlet or the like which may cause a vortex to form. This is undesirable since it also develops a tendency to trap a swimmer under water.

Recent regulations in code specifications for swimming pools, therapy pools, hot tubs, saunas and the like require that a design for drain covers cannot be approved unless actual full-size units pass several tests, performed by a licensed testing laboratory. These tests include a progressive static load test, an impact test where a load is dropped onto the center of the cover, and a flow restriction test. The total area of all openings associated with the drain cover permitting flow from the pool into the drain beneath the drain cover must be sufficient to avoid restricting the flow appropriate to the specific drain size for which it is intended. Some codes restrict the maximum size of openings to five-eighths, or even one-half, inch to prevent fingers and toes from entering. Also, specified for some codes is the requirement that these holes be arranged and located such that they cannot be covered (closed) by any part of the body, including hands and feet. These requirements and restrictions tend to direct that complaint drain covers will have some part of the cover spaced away from the surface in which the drain is located in order to keep the flow passages clear. This also causes the drain cover to become a possible hazard to toe stubbing or to impact with other body parts subject to encounter as a swimmer is skimming along the bottom of the pool.

SUMMARY OF THE INVENTION

In accordance with the present invention, there is provided an improved protective cover for the drain of a swimming pool or the like which avoids the disadvantages of prior art covers. The cover of the invention has a main portion which consists preferably of an injection-molded plastic, and has no openings whatsoever. The central part of the cover is inwardly curved and forms essentially a portion of a sphere having its center on a line perpendicular to a plane through the cover. The central portion is surrounded by an intermediate portion which, again, is inwardly directed from the edge of the central portion. At the lowest part of the intermediate portion, there is provided on the inside a circular rim which serves multiple purposes. It lends mechanical strength to the central part of the cover and facilitates injection-molding. The outer portion of the cover is curved outwardly and then inwardly again. It is connected to an annular support rim by a plurality of equally spaced stanchions in the form of vanes, each of which extends in a radial direction. These vanes are of substantially equal strength and are integrally molded substantially to the entire surface of the annular rim.

The rim may be provided with screw holes extending therethrough. The vanes near the screw holes are of lesser radial extent so as not to interfere with the screws connecting the cover of the invention to a sub-main drain. Preferably the vanes adjacent the screw holes are thicker than the other vanes so that they will be of equal strength, even though they are of lesser radial dimension.

The annular rim of the cover may be provided with locating tabs which fit into corresponding openings in the sub-main drain. These tabs extend downwardly, normal to a plane through the annular rim. It should be noted that the main portion of the cover has two annular, upwardly extending bulges or projections, which pass through a single plane.

With the instant invention, the undulating contour of concentric, tangent toroidal surface sections is such that the cross section is of sinusoidal form. There is no radial tensile stress possible until and unless a sustained overload condition has inverted the cover well below the support rim, and has converted the entire form to that of a conical hollow supported at the rim. Even in this severe overload condition, the cover continues to perform all of its mechanical functions. With this slow yielding under overload, and even during the slow-motion failure, the drain remains covered, the anti-vortex action is intact, and the flow passages cannot be covered by a swimmer, while the peripheral support stanchions are intact.

As loads are applied to the cover at the center, the downward deflection of the center is also observed in the adjacent annular trough surrounding the inner annular bulge. There is no appreciable deflection at the rim, though slight downward bending of the outermost annular bulge begins as the center is depressed initially under load. As the load is increased, the toroidal convolutions are unbent, providing an essentially constant force spring within the elastic range of the material, and an energy-absorbing extensibility in the overload range.

As the inner annular bulge tends to be flattened under load, its conjunction with the adjacent annular trough tends to move outwardly, causing the annular trough to move outwardly to accommodate the radial extension of the inner annular bulge. Thus it can be seen that to restrain this radial deflection is to increase the resistance to deflection in the axial direction also. Therefore, an annular ring projection on the underside of the trough will provide added hoop strength in this area, while leaving the top surface smooth. The extent of this added ring projection can be varied within reasonable limits to gain added stiffness to the cover.

Since the center of the cover is contoured to be below the uppermost contour surrounding the center, all usual loads are prevented from being directly applied to the actual center area, except for test conditions. Thus is avoided a condition of tri-axial stress in which the tensile stress radiates from the center to the edges where the load is transferred to the support means. For a flat plate-type of cover, the radial tensile stress from a swimmer jumping feet-first into the pool and landing on the cover could cause a cataclysmic fracture across a flat cover such that the resultant separation could spring back shut sufficiently to pinch a swimmer's foot either at the time of fracture, or subsequently if the cover should be left in place.

If the cover were constituted by a single spherical surface inwardly curved, the stress patterns would be insignificantly better than for the flat plate, and cataclysmic failure of the same type and with the same hazards would result. Further, the periphery of such a cover would present a raised ring which is considered a hazard potential to cause bruises or more serious injury. For those covers characterized by a portion of a spherical surface similar to a dome, a load of any point is applied to a spherical surface such that the compressive stress at the load point is transmitted radially from that point, much as for the case with an egg. However, as the stress is transferred toward the periphery, the circumferential tensile stress is increased. Since the height of the cover above the surface in which it is installed is limited because of code regulations, the periphery of the cover at the support rim encounters a severe circumferential tensile stress. This is aggravated by the necessity to provide fluid passages at this same periphery, reducing the material available to absorb the load. Therefore, the incidence of a load capable of causing failure, whether static or impact, will cause a cataclysmic failure with the above-cited hazardous contingencies.

The pool drain cover of the present invention will prevent the formation of vortices, due to the radial arrangement of the stanchions configured as vanes forming a turbine-like fluid flow. The central portion forms a bellows spring which has considerable shock-absorbing capability and extensibility. Due to the elastic properties of the plastic of which the cover is made, the central portion will snap-back under loads which do not exceed the elastic limits of the material. Even overloads which permanently deform the cover do not impede the full function of the cover unless the overload is so excessive and sustained as to physically break the cover. Destructive testing has revealed that before failure of the cover, there is a time delay which will give a swimmer an opportunity to step away from the cover or remove the overload before the cover fails.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENT

Figure 1:
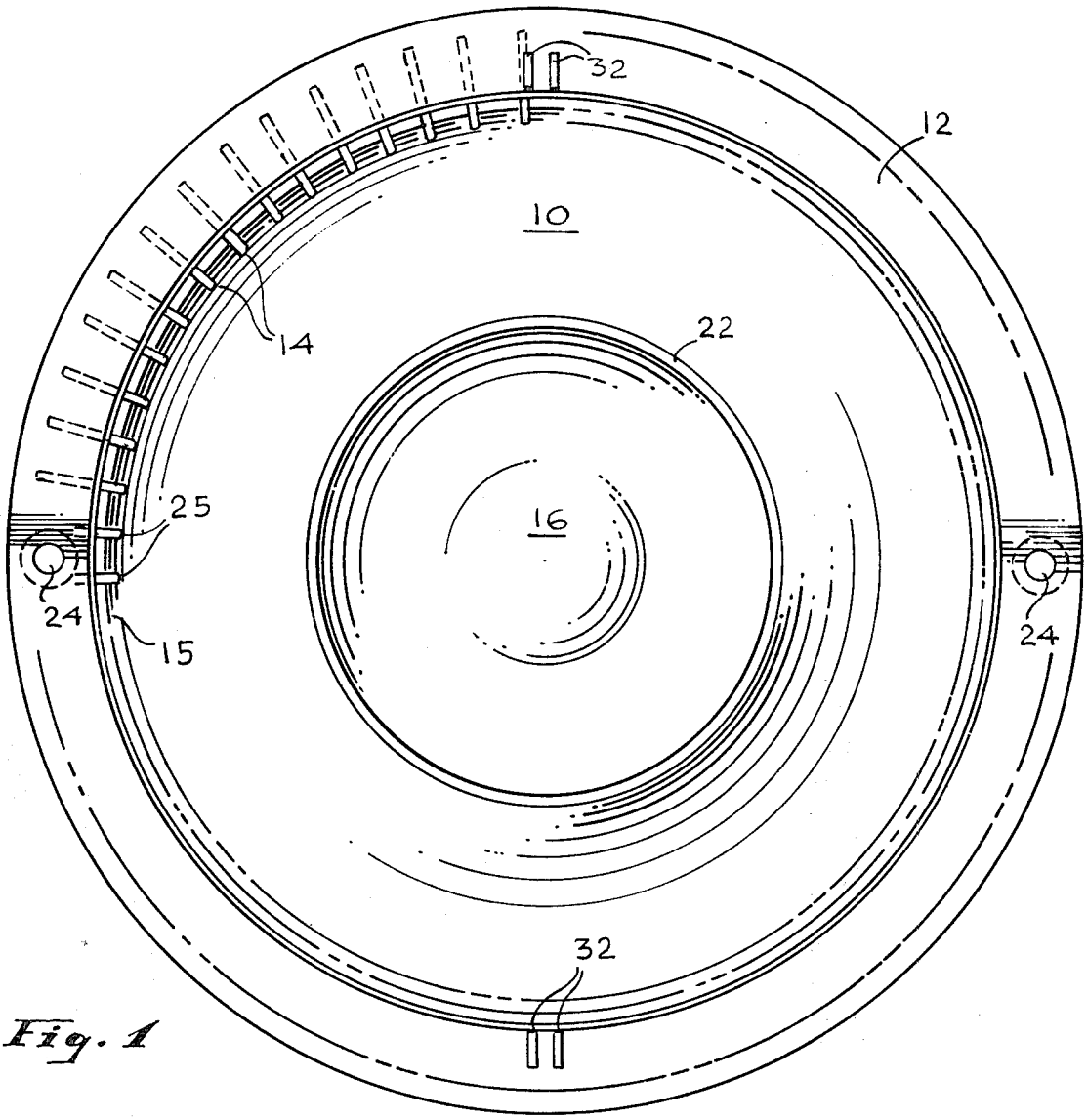
FIG. 1 is a bottom view of the cover of the present invention.
Figure 2:
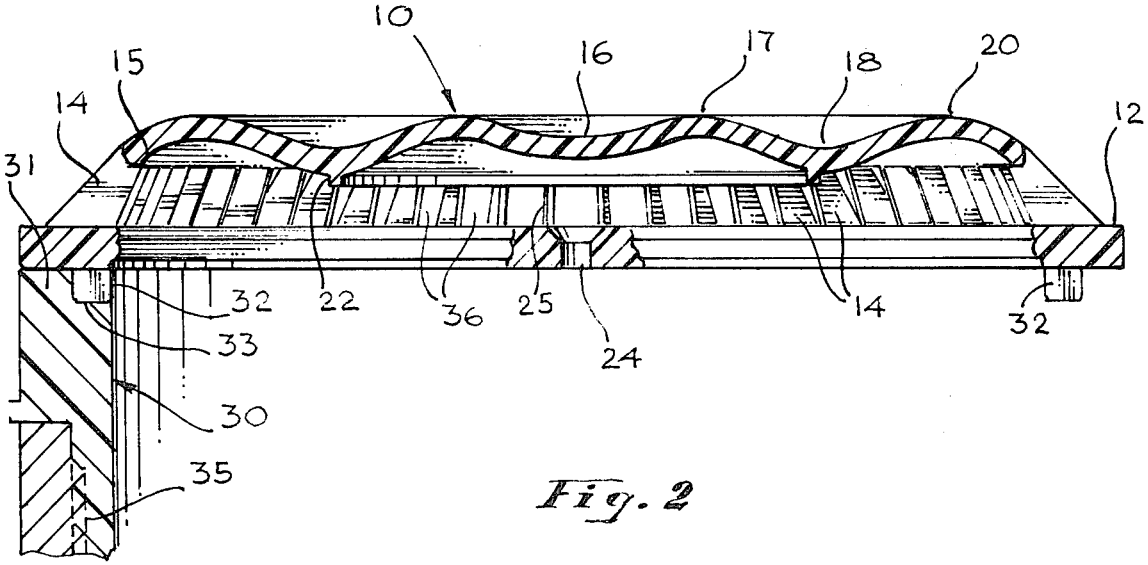
FIG. 2 is an elevational cross-sectional view of the cover of FIG. 1, and including a portion of the sub-main drain on which the cover is intended to rest.

Referring now to the drawings and particularly to FIGS. 1 and 2, there is illustrated a preferred embodiment of the drain cover of the present invention. The cover includes a top portion 10 and an annular rim 12 which are interconnected by a plurality of radial vanes 14 connected between the outer rim 15 of the top cover 10 and the flat top surface of the annular rim 12.

As illustrated particularly in FIG. 2, the top portion 10 which has a circular outline is provided with a central section 16 which generally extends inwardly. It has an outwardly curved, circular bulge 17 followed by an inwardly extending, annular section 18 which, again, is followed by an outwardly curved bulge 20. The two bulges or projections 17 and 20 are disposed in a single plane, as clearly shown in FIG. 2.

Thus, the sections 16 and 18 may be considered to be of a sine wave shape and form a bellows-like spring. Preferably, the top portion 10 and the annular rim 12 with the vanes 14 are of unitary construction, and consist of an injection-molded plastic, such as a plastic known as ABS.

Preferably, the inwardly, downwardly extending section 18 is provided on its lower surface with a circular protrusion 22. The protrusion 22 extends substantially normal to the single plane passing through the projections or bulges 17 and 20.

The protrusion 22 serves to lend mechanical rigidity to the drain cover. Thus, it lends hoop strength to the structure and added resistance against applied loads, as will be subsequently explained. It also facilitates the flow of the plastic during the injection-molding of the cover. The plastic is injected from the center of the top portion 10. The plastic then flows in radial directions outwardly. Subsequently, the circular protrusion 22 acts as a weir to stabilize the flow. From the weir 22, the plastic then flows, again in a radial direction so that it will arrive at all portions of the cover, including the annular rim 12, substantially at the same time so that it does not have an opportunity to harden before the entire cover has been injection-molded.

As also clearly shown in FIG. 2, the rim 12 has its top and bottom surfaces defined by parallel planes which are parallel to the plane passing through the portions 17 and 20. The cross-section of the top portion 10 is of substantially uniform thickness as will be evident from an inspection of FIG. 2.

The annular rim 12 is preferably provided with two oppositely disposed screw holes 24. The purpose of the screw holes 24 is to secure the cover of the invention to a suitable fixture, such as a sub-main drain of a swimming pool or the like. In order to provide unrestricted access to the screw holes 24, the two vanes 25 adjacent the screw holes 24 are of shorter length along the annular rim 12 so as not to interfere with the screws.

Shown in FIG. 2 is a portion of a sub-main drain upon which the cover of the invention rests. The sub-main drain 30 is of generally cylindrical construction and is provided with an upper annular portion 31, upon which the rim 12 rests. The rim 12 may be provided with locating projections in the form of two tabs 32 which, in turn, fit a recess 33 in the main drain 30. The main drain 30 may then be provided with an opening 35 provided with screw threads for connection to a suitable water pipe.

It will be evident from the description of FIGS. 1 and 2, that the cover of the invention has desirable features. It is non-metallic and resilient to withstand substantial loads. The top portion is formed by two successive sine wave sections forming a bellows spring. Due to the radial openings 26 between the vanes 14, the formation of a vortex is substantially prevented. The stanchions or vanes supporting the upper portion 10 above the annular mounting rim 12 are located relatively close together and are slanted at their outer edges, thus protecting against a swimmer stubbing his toes or otherwise bruising himself by contact with the cover. Because the top portion 10 is devoid of any openings, there is no suction which may be exerted on a swimmer's body; nor is it possible for a person to have his fingers caught in the fluid flow openings 36 because they are too small.

Figure 3:
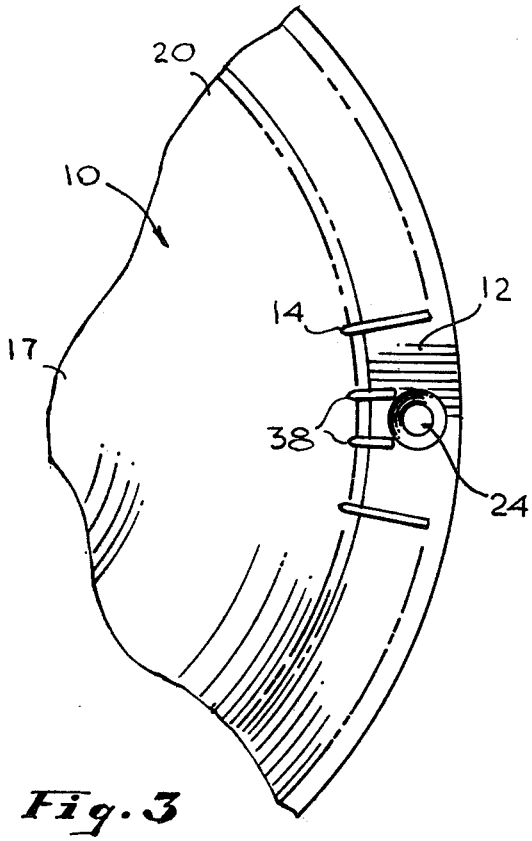
FIG. 3 is a partial top view of the outer rim of the cover showing the vanes in the neighborhood of a screw hole.
Figure 4:
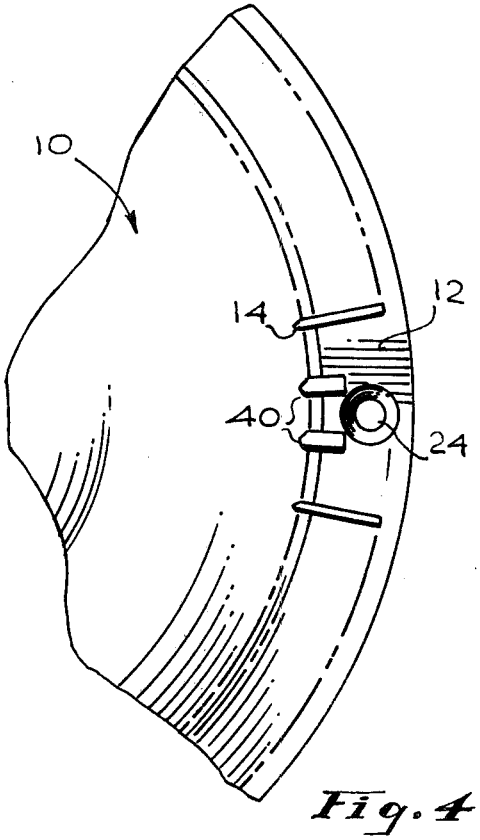
FIG. 4 is a partial top view similar to that of FIG. 3, and illustrating two vanes adjacent a screw hole and having greater thickness, thereby to provide equal strength of all the vanes.

FIG. 3, to which reference is now made, illustrates a partial top view of the annular rim 12 and central cover portion 10 in the neighborhood of a screw hole 24. As shown here, the two vanes 38 about the screw hole 24 have the same thickness as the vanes 14, but are of shorter length. However, as illustrated in FIG. 4, the two vanes 40 adjacent the screw hole 24 are preferably made somewhat wider so that, in spite of their shorter length, they have the same strength as the remaining vanes 14 connected between the top portion 10 and the annular rim 12.

Figure 5:
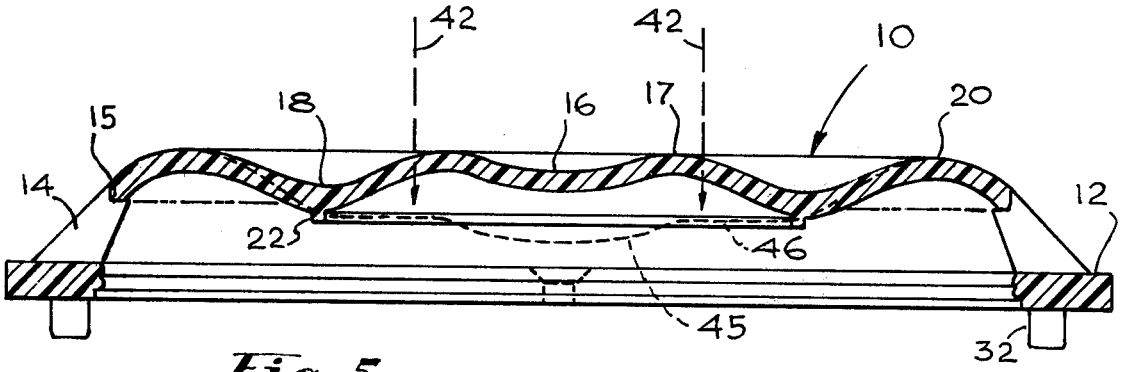
FIG. 5 is a sectional view similar to that of FIG. 2, and illustrating temporary deflection of the central part of the cover due to an applied load within the elastic limit of the material.

The cover of the invention has been subjected to various types of tests. Thus, impact loads, that is, suddenly applied loads, as well as static loads, were applied to the center portion 16 of the cover. When these loads were within the elastic limits of the material, they do not cause permanent deformation. This is illustrated in FIG. 5, to which reference is now made. The load was applied, as shown by dotted lines 42, that is, to the central section 16 and the bulge 17 of the top portion 10. The cover was temporarily deformed, as shown by the dotted line 45. Thus, the central section 16 and adjacent areas were downwardly deformed along a portion of a circle. The bulge 17 was substantially flattened out, as shown in 46. However, the outer bulge 20 remained substantially unchanged.

Thus, the center convolution 16 is substantially inverted. There exists a constant force spring zone in which the cover absorbs both shock and static loads. This reduces the likelihood of structural failure or deformation from momentary overloads, most commonly caused by a swimmer pushing off from the drain cover or landing on it in diving or jumping into the pool, since the time required for permanent deformation to occur exceeds the usual momentary overload. After the load is removed, the cover springs back substantially to its original shape.

Figure 6:
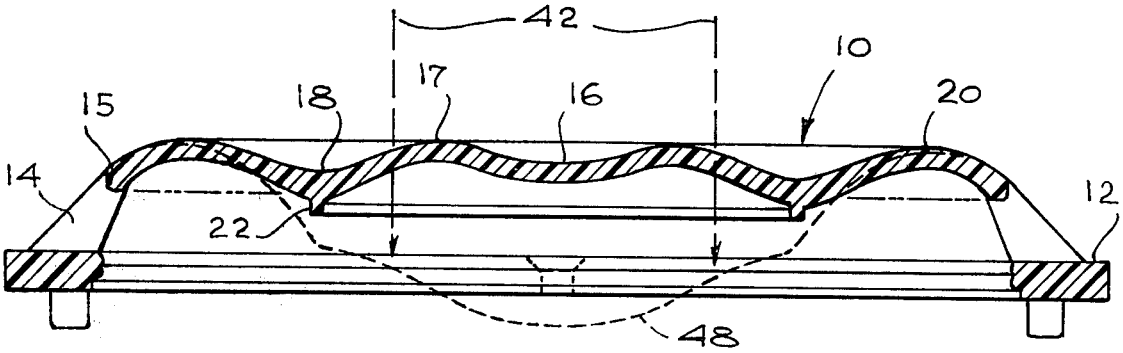
FIG. 6 is a sectional view similar to that of FIG. 5, and illustrating permanent deformation of the cover as a result of overload forces acting on the center thereof which are beyond the elastic limit of the plastic material.

The results of overload forces beyond normal limits, that is, beyond the elastic limit of the material, are illustrated in FIG. 6, to which reference is now made. The overload force was again applied, as shown by dotted lines 42, over the central section 16 of the top cover, and somewhat beyond the bulge 17. In this case, the cover has been strained beyond its elastic limits, resulting in a plastic flow area. The resulting, permanent deformation or so-called set is illustrated by the dashed lines 48. It will be seen that the entire central section 16, the bulge 17 and a portion of the annular depression 18 are downwardly deflected, as shown by the dotted lines 48. However even this overload, while deforming the cover, does not yet result in any breakage of the entire structure. This will require even greater overloads.

The tests have shown that the cover will withstand about 800 pounds at the center for two minutes with little permanent set. However, a load of 1,000 pounds for a length of time of over 20 seconds results in a failure, that is, in a breakage between the top portion 10 and the annular rim 12, due to breakage of the vanes 14. Greater strength may be had by adding plastic to the projection beneath the trough area of the cover if necessary.

There has thus been disclosed a drain cover for pools which prevents formation of a vortex. The top portion of the cover is devoid of any openings, thus greatly minimizing any danger to a person using the pool. The drainage holes are disposed in a radial direction to provide a smoothly directed turbine-like flow. The entire structure is injection-molded from a flexible, spring-like, tough plastic. The top portion of the cover is of substantially uniform cross section, except for a projection of circular shape at its underside, which extends substantially normal through a plane passing through the projections of the top cover. This annular projection lends mechanical rigidity to the cover, and facilitates injection-molding.

Although the preferred embodiment of the invention is shown and described as a configuration of concentric portions smoothly joined in a manner developing a wave-like diametric cross section approaching a sine wave in form, variations and modifications may be made to this preferred shape without departing from the principles and concepts of the invention. For example, the upper portion of the cover supported by and extending between the support stanchions may comprise a plurality of off-set planar surfaces in the form of concentric rings joined by conical intermediate or transition zones intersecting the rings in concentric lines. The off-set planar surfaces are preferably non-co-planar and the central section is depressed below or recessed, relative to its adjacent, radially outward planar surface or ring. Such an arrangement will provide shock resistance and great extensibility along its axis before fracture under load. The planar surfaces and conical intermediate zones act under load much as Belleville springs, helping to distribute the load evenly in all radial directions. The intermediate conical surfaces further act as hoop strength members and will flare or otherwise shift under load in a generally outward direction to provide extensibility.

In another variation within the scope of the present invention, the cover extending between and supported by the vaned stanchion members may be essentially flat and co-planar except for a depressed, symmetrically-shaped, curved central portion. In a similar variant, the cover portion may comprise a central, curved portion depressed inwardly, surrounded by an adjacent sloping ring portion of substantial radial extent and joined to an outer, curved toroidal portion attached to the supporting stanchions. The intermediate slanted portion of this variant acts in the manner of a Belleville spring and the toroidal surface of the radially outward section tends to yield under load by curling downwardly. In these variations providing a central curved, depressed section (including the preferred embodiment described hereinabove) the shape of the curve may be spherical, catenary, parabolic, or otherwise as desired. It should, however, be symmetrically shaped about the cover axis. Although certain of these variations inherently provide hoop strength by virtue of configurations employing adjacent intersecting planar surfaces, additional hoop strength can be provided by incorporating ring protrusions, such as the protrusion 22 in FIG. 1 of the drawing of the preferred embodiment, at strategic radial positions.

Another variant which may be employed may comprise a plurality of adjacent intersecting conical surfaces or rings extending across the upper face of the cover such as to develop an essentially zig-zag diametric cross-section. Preferably the central portion is a curved section, such as previously described. In such a cover configuration, the conical surfaces or rings act like a bellows spring under load, deforming equally and distributing the load radially in all directions.

In all of these configurations, the cover is preferably symmetrical about its central axis so that applied forces will be distributed evenly and the deformation of the cover under load proceeds with a minimum concentration of stress at any particular point.

Although there have been described above specific arrangements of a vaned anti-vortex pool drain cover in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A drain cover for a swimming pool or the like, comprising:

an annular support ring adapted for attachment to a drain housing; and a cover portion displaced from the plane of the ring and joined thereto by a plurality of generally equally spaced, radially-directed support stanchions defining a plurality of openings about the periphery of the cover, the cover portion comprising a central, curved, recessed section smoothly joined to the surrounding remainder of the cover portion, said cover portion being continuous throughout its extent and symmetrical about the central axis of the cover.

2. The cover of claim 1 wherein the remainder of the cover portion surrounding the recessed section comprises a circular depressed section joined thereto in a smooth transition such that the diametric cross-section of the cover generally resembles a sine wave in appearance.

3. The cover of claim 1 wherein the cover portion includes a radially outward circumferential section smoothly faired into the juncture with the stanchions joined thereto.

4. The cover of claim 3 wherein the stanchions are in the form of vanes aligned radially with the axis of the cover and extending radially outward from the edge of the cover portion to the support ring.

5. The cover of claim 4 wherein the cover portion has a circumferential rim curved on its outer surface and wherein the outer edges of the vanes comprise essentially straight lines tangentially joining the curved surface of the circumferential rim.

6. The cover of claim 1 wherein the stanchions comprise vanes spaced between one-quarter and one-half inch apart at their radially inward edges.

7. The cover of claim 6 wherein the spacing between the outer edge of the cover portion and the plane of the support ring is between one-quarter and one-half inch.

8. The cover of claim 1 wherein the aggregate cross-sectional area of all of the openings defined by the stanchions is substantially in excess of the cross-sectional area of the drain conduit for which the cover is designed.

9. The cover of claim 1 wherein the support ring includes a plurality of openings for mounting screws located partially between pairs of adjacent stanchions, which adjacent stanchions are foreshortened and thickened, relative to the other stanchions, so as to provide equivalent support strength for the cover portion in all of the stanchions.

10. The cover of claim 1 wherein at least the cover portion is fabricated of a resilient, tough, flexible, spring-like plastic.

11. The cover of claim 1 wherein the cover portion is provided with successive, concentric, sections with adjacent ones of said sections being joined together to develop a spring-like member deformable generally equally in all radial directions under load.

12. The cover of claim 1 wherein the openings are of like shape and corresponding dimensions, the openings being of such a size as to preclude entry of a swimmer's finger therein.

13. The cover of claim 1 wherein the cover portion has a surface contour comprised of concentric, annular, toroidal sections merging tangentially at their conjunctions to establish a generally sinusoidal diametric cross-section.

14. The cover of claim 1 wherein the cover portion is displaced above the plane of the support ring and said openings are recessed from the outer surface of the cover so as to preclude closing off any significant proportion of the openings by a swimmer's body.

15. A drain cover for a pool comprising:

a cover portion including a central substantially circular section and at least one concentric annular section, said central and annular sections being interconnected by at least one transition section, the central section having a curved recessed segment at its center;

an annular support ring defining a plane displaced axially from the cover portion; and a plurality of radially oriented stanchions extending between said ring and the outer rim of the outermost annular section, said stanchions being spaced from each other to permit the flow of water therethrough, whereby said cover portion has spring-like properties under load and is capable of temporary deflection under design loads or permanent deformation when overloaded beyond the elastic limit of the material of said cover portion.

16. A cover as defined in claim 15 wherein said transition section is in the shape of a conic section.

17. A cover as defined in claim 15 wherein said transition section is curved.

18. A cover as defined in claim 15 wherein the cover portion has a surface contour formed of concentric annular toroidal sections tangent in the transition section such that the diametric cross-section is generally sinusoidal.

19. A cover as defined in claim 15 wherein the cover portion includes a protruding concentric ring on its under side for providing increased hoop strength.

20. A drain cover for a pool comprising:

a circular top portion of generally wavy form and including a generally inwardly extending central section surrounded by an outwardly curved section merging into an inwardly extending annular section having another outwardly curved section terminated by a circumferential rim;

a substantially annular support ring displaced axially from the top portion; and said annular rim and said top portion being interconnected by a plurality of equally-spaced, radially aligned stanchions extending from the rim of said top portion to the annular ring, whereby said central portion has shock absorbing properties and unusual extensibility under load, and whereby said stanchions are configured as vanes to prevent the formation of a vortex, said drain cover being of unitary construction and consisting of an injection-molded plastic.

21. A cover as defined in claim 20 wherein the lower surface of said inwardly extending annular portion is provided with a circular protrusion extending normal to said single plane to lend hoop strength to said cover.

22. A cover as defined in claim 20 wherein screw holes extend through said annular ring, the vanes adjacent said screw holes being of reduced radial extent to provide free access to said screw holes.

23. A cover as defined in claim 22 wherein said vanes of reduced extent adjacent said screw holes have a greater thickness than the remaining vanes so that all vanes are of substantially uniform strength.

24. A cover as defined in claim 20 wherein said central section forms a section of a sphere having its center along an axis extending through the center of said cover and normal to the plane of the support ring.

25. A cover as defined in claim 20 wherein the plastic of said cover has spring-like properties, whereby the central portion of said cover is shaped to function like a bellows spring so that a load imposed on said cover less than the load causing permanent deflection will permit, after removal of the load, said central portion to spring back substantially to its original shape.

26. A cover as defined in claim 20 wherein said annular ring is provided with locating projections extending from the surface thereof remote from the top portion.

27. A cover as defined in claim 20 wherein said top portion has a substantially uniform cross section.

* * * * *